US010535967B2

(12) United States Patent
Frederiksen

(10) Patent No.: US 10,535,967 B2
(45) **Date of Patent: *Jan. 14, 2020**

(54) ELECTRICAL SUPPLY SYSTEM

(71) Applicant: LED IBOND INTERNATIONAL APS, Kgs. Lyngby (DK)

(72) Inventor: Lars Frederiksen, Gentofte (DK)

(73) Assignee: LED IBOND INTERNATIONAL APS, Lyngby (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/345,839

(22) PCT Filed: Apr. 7, 2017

(86) PCT No.: PCT/DK2017/050113

§ 371 (c)(1),
(2) Date: Apr. 29, 2019

(87) PCT Pub. No.: WO2018/077359

PCT Pub. Date: May 3, 2018

(65) Prior Publication Data

US 2019/0252839 A1 Aug. 15, 2019

(30) Foreign Application Priority Data

Oct. 31, 2016 (WO) ..... PCT/DK2016/050349

(51) Int. Cl.
*H01R 33/88* (2006.01)
*F21V 23/06* (2006.01)
(Continued)

(52) U.S. Cl.
CPC ..... *H01R 33/88* (2013.01); *F21V 23/06* (2013.01); *H01R 4/2416* (2013.01); *H01R 33/18* (2013.01);
(Continued)

(58) Field of Classification Search
CPC ..... H01R 33/88; H01R 33/18; H01R 4/2416; F21V 23/06; F21Y 2115/10
(Continued)

(56) References Cited

U.S. PATENT DOCUMENTS

2015/0198314 A1 7/2015 Frederiksen

FOREIGN PATENT DOCUMENTS

DE 102008021014 A1 10/2009
EP 2485342 A2 8/2012
(Continued)

OTHER PUBLICATIONS

International Search Report (PCT/ISA/210) dated May 22, 2017, by the European Patent Office as the International Searching Authority for International Application No. PCT/DK2017/050113.
(Continued)

*Primary Examiner* — Harshad C Patel
(74) *Attorney, Agent, or Firm* — Buchanan Ingersoll & Rooney P.C.

(57) ABSTRACT

An electrical supply system including: an extension module including a composite board having an anode layer and a cathode layer of an electrically conducting material, which anode layer and cathode layer are separated by an insulator of an electrically insulating material, the anode layer and the cathode layer each having a trench extending from a connection surface of the composite board and including a connection element, connector pins for the trenches of the extension module, each connector pin having a first complementary connection element for engaging the connection element of the trench of the composite board of a further extension module and a second complementary connection element for engaging the connection element of the trench of the composite board of the extension module, and a power
(Continued)

supply capable of providing a constant voltage or a constant current between the anode layer and the cathode layer.

17 Claims, 4 Drawing Sheets

(51) Int. Cl.
*H01R 4/2416* (2018.01)
*H01R 33/18* (2006.01)
*F21Y 115/10* (2016.01)
*H01R 13/24* (2006.01)

(52) U.S. Cl.
CPC ..... *F21Y 2115/10* (2016.08); *H01R 13/2492* (2013.01)

(58) Field of Classification Search
USPC ..... 439/540.1
See application file for complete search history.

(56) References Cited

FOREIGN PATENT DOCUMENTS

| | | | |
|---|---|---|---|
| WO | 9939319 | A2 | 8/1999 |
| WO | 03017435 | A1 | 2/2003 |
| WO | 2009076960 | A1 | 6/2009 |
| WO | 2013117198 | A1 | 8/2013 |
| WO | 2015036330 | A1 | 3/2015 |
| WO | 2015104024 | A1 | 7/2015 |

OTHER PUBLICATIONS

Written Opinion (PCT/ISA/237) dated May 22, 2017, by the European Patent Office as the International Searching Authority for International Application No. PCT/DK2017/050113.

ELECTRICAL SUPPLY SYSTEM

FIELD OF THE INVENTION

The present invention relates to an electrical supply system comprising an extension module comprising a composite board with two layers of an electrically conducting material separated by an insulator, and a power supply capable of providing power to the electrically conducting layers. The electrical supply system offers greater flexibility since the extension module can be easily coupled to a another extension module.

PRIOR ART

Composite boards are well known construction elements for LED based lamps where two electrically conducting plates separated by an insulating material are used to supply electricity to and from LED's mounted in the composite board. Thus, WO 2003/017435 discloses an adapter for electrical power transfer for mounting in an aperture in such a composite board. The adapter comprises first pins establishing electrical connection with one of the layers when the adapter is mounted in an aperture, and a second pin adapted for establishing electrical connection with the other layer when mounting the adapter in the aperture.

WO 2009/076960 discloses an adapter with a LED for mounting in a hole in a composite board where the LED is fitted on a metal item. The heat conducting properties of the metal item are utilised for conducting heat from the LED away from the adapter and into the board while simultaneously operating as an electric conductor.

Other such systems are disclosed in EP 2485342, DE 102008021014 and WO 2013/117198.

WO 2015/104024 discloses a composite board with a circuit board carrying a LED in electrical connection with the first and the second electrically conducting layers. The composite board may comprise a controller adapted for communication of data signals via one of the electrically conducting layers to the LED.

However, neither of the above documents provides much flexibility since the fixtures cannot be modified with respect to size, especially with respect to the number of LED's or other electronic components and their positioning in the systems.

It is an object of the present invention to provide an electric supply system allowing flexibility with respect to adding or removing electronic components, e.g. LED's, and supplying electricity to electronic components.

DISCLOSURE OF THE INVENTION

The present invention relates to an electrical supply system comprising:

an extension module comprising a composite board having an anode layer and a cathode layer of an electrically conducting material, which anode layer and cathode layer are separated by an insulator of an electrically insulating material, the anode layer and the cathode layer each having a trench extending from a connection surface of the composite board and comprising a connection element, connector pins for the trenches of the extension module, each connector pin having a first complementary connection element for engaging the connection element of the trench of the composite board of a another extension module and a second complementary connection element for engaging the connection element of the trench of the composite board of the extension module, and a power supply capable of providing a constant voltage or a constant current between the anode layer and the cathode layer.

The extension module may further comprise an adapter for mounting in a hole extending entirely through or partly through the composite board, the adapter comprising a circuit board carrying an electronic component, the circuit board establishing electrical connection from the anode layer to an anode of the electronic component and electrical connection from the cathode layer to a cathode of the electronic component. In particular, the electrical supply system, e.g. the extension board, comprises a plurality of adapters.

In an embodiment, the electrical supply system further comprises an electronic unit having a connection site with a connection element for engaging the complementary connection element of the connector pin, and an electronic component electrically connected to the connection element. The connection site may have any and all features described for the trenches of the extension module, where they provide the same functionality. The electronic unit may also comprise a connector pin, e.g. a connector pin for the anode and/or a connector pin for the cathode, with a complementary connection element for engaging the connection element of the trench of the anode layer or the cathode layer of the extension module, and the electronic component is electrically connected to the connector pin. In particular, the electronic unit may have a connector pin in electrical connection with an anode of the electronic component and a connector pin in electrical connection with a cathode of the electronic component. The connector pins may be separate from the electronic unit or they may be integral with the electronic unit. The connector pins of the electronic unit may have any and all features described for the connector pins of the extension module, where they provide the same functionality.

The electrical supply system of the invention requires a single extension module, but it may contain any number of extension modules. Multiple extension modules can be connected to a single extension module with appropriate connection surfaces, or multiple extension modules can be connected serially to each other. An extension module may also have multiple connection surfaces. The extension module may also be referred to as a supplementary module and the two terms may be employed interchangeably in the context of the invention. Likewise, the electrical supply system may comprise any number of electronic units as defined above. An electronic unit may be the last module connected to a series of extension modules, or an electronic unit may be integrated between extension modules. It is also possible to serially connect two or more electronic units in the electrical supply system.

The extension module of the invention may also be referred to as an "electrical supply module", and both are, in the context of the invention, a module for supplying electricity to an electronic component carried on a circuit board in an adapter, e.g. in the extension module, to an electronic unit or to another electrical device requiring a direct current. The terms "extension module" and "electrical supply module" may be used interchangeably. In the context of the invention an "electrical supply system" is a system comprising an extension module where the anode layer of the extension module may be in electrical connection with the anode layer of a another extension module, and the cathode layer of the extension module is in turn in electrical connection with the cathode layer of the another extension module. Likewise, the anode layer and the cathode layer of a first extension module may be in electrical connection with an anode and a cathode, respectively, of an electronic component of an electronic unit. The electrical supply system is especially suited for supplying a low voltage, e.g. 12 V or 24 V, direct current to a component, e.g. an electronic component, over long distances, e.g. several meters. The electrical supply system is not limited to low voltage and it can be used with a voltage of e.g. 60 V. Moreover, by electrically connecting a first extension module with a another extension module via the connector pins and the trenches a highly flexible system is provided for supplying a direct current to a component. Since the power supply provides a constant voltage or a constant current between the anode layer and the cathode layer electronic components may be easily connected to the electrical supply system at any location, e.g. as part of the adapter or in an electronic unit. By having an anode layer and a cathode layer of an electrically conducting material and a power supply providing a constant voltage or a constant current between the anode layer and the cathode layer a plurality of adapters with electronic components as defined above, or a plurality of electronic units, or a combination thereof, will be connected in parallel. Parallel connection of a plurality of electronic components with a constant current or a constant voltage in the electrical supply system provides a flexible system where additional electronic components can be added to or removed from the system in a simple fashion. For example, a hole may be provided either partly or entirely through the composite board and an adapter with the additional electronic component may be mounted in the hole, or additional electronic components may be part of an extension module or an electronic unit, which may be connected to the extension module, e.g. the first extension module having the power supply. Likewise, due to the constant current or constant voltage a section of a composite board with a plurality of adapters may be removed, e.g. by cutting, without detrimental effects to adapters and their corresponding electronic components remaining in the composite board. Supplying power via the conducting layers removes the need for separate wiring to each electronic component thus providing a simple system.

When the electrically conducting material is a metal, in particular aluminium or copper, the resistance of the electrically conducting material is generally so low that the extension module, or the electrical supply system, is not limited with respect to size. In particular, the cross-sectional area of the anode layer and the cathode layer will be much larger than the cross-sectional area of the wires typically employed in electrical supply systems and thereby the resistance of metallic electrically conducting layers will be correspondingly lower. The same is true when the electronic component is contained in an electronic unit: further units may be added to the electrical supply system, or already added electronic units may be removed from the system.

A composite board having metallic anode and cathode layers will inevitably have conducting cross-sectional areas far surpassing the cross-sectional area commonly found in electrical wires. This is especially advantageous for an electric supply system supplying a low voltage, e.g. 12 V or 24 V, direct current to an electronic component. The large cross-sectional area of metallic anode and cathode layers further allows multiple, e.g. 10 or more or 100 or more, electronic components to be supplied with the direct current without a significant voltage drop from the first to the last extension module. The electrical supply system of the invention is thus especially advantageous for supplying a low voltage, e.g. 12 V or 24 V, direct current over long distances, since any electronic component supplied with the direct current will receive the constant voltage of the power supply, regardless of where in the electric system it is located. The large cross-sectional area of metallic anode and cathode layers further prevents an increase in the temperature of the extension board due to the low resistance of the metal. Furthermore, when the metals of the anode and cathode layers has been anodised, an end user is protected from electric shocks due to the electrical isolation provided by the anodisation. Thereby, an end user may add or remove further extension boards without shutting off the power supply.

The electronic component may be any electronic component. In an embodiment the electronic component is a light emitting diode (LED). The extension module or extension modules of the electrical supply system of the invention may have any number of adapters, preferably at least two adapters. In a certain embodiment the extension module comprises from 2 to 300 adapters, e.g. with LED's. When the extension module comprises a plurality of adapters with LED's or series of LED's it is preferred that the power supply provides a constant voltage. In another embodiment the extension module comprises up to 1000 adapters, e.g. 1 to 1000 adapters, with an electronic component. The adapters can be positioned freely on the surface of the composite board, since the layers of conducting material supply power to the electronic components. Especially when the electrically conducting layers are metallic the resistance between adapters will be insignificant regardless of the distance between the adapters. Thus, the positioning of the adapters on the composite board is independent of electrical wiring or specific positions on a circuit board. In particular, this freedom of positioning electronic components, e.g. adapters with LED's, on a two-dimensional surface cannot be achieved in the linear strip systems of the prior art. Thus, the adapters may be positioned freely on the surface defined by the composite board. For example, the adapters may be positioned at regular intervals, e.g. with a distance between the adapters, e.g. with LED's, in the range of from 25 mm to 1000 mm, e.g. about 100 mm or 200 mm. When adapters with LED's are positioned close to each other, e.g. at a distance of 25 mm or less it is possible to obtain a very high luminous intensity. An extension module with a large distance, e.g. 500 mm or more, between the adapters can also take advantage of the flexibility described above—in particular the lack of individual wiring is an advantage for extension modules having a distance between the adapters at 500 mm or more. Likewise, the distance between the adapters may also be smaller, e.g. in the range of 100 mm to 300 mm, such as about 200 mm.

The adapters can also be positioned in different patterns in the composite board, since the positioning is independent on any wiring as the electrically conducting layers supply the electronic components with power. Furthermore, the electrically conducting layers of the composite board allow that a another extension module is connected electrically to an extension module as defined above. This allows a further level of freedom in designing an electrical supply system especially when the electronic components comprise LED's, which cannot be achieved with strip based LED fixtures of the prior art. In particular, no additional wiring is needed since the electrical connection between the first extension module and any another extension module(s) can be obtained using connector pins or coupling devices as defined below.

The power supply may be connected to the extension module as desired. For example, the power supply may be wired to the anode layer and the cathode layer at any location on the composite board. In certain embodiments the power supply provides a constant voltage of a standardised value, e.g. 12 V or 24 V. In a specific embodiment the power supply is electrically connected to the anode layer and the cathode layer using wires and any appropriate connector. In another embodiment the power supply comprises connector sites as defined above for the electronic unit. Likewise, the power supply may also comprise a connector pin with a complementary connection element for engaging the connection element of the trench of the anode layer or the cathode layer of the extension module. The connection site and the connector pins of the electronic unit may have any and all features described for the trenches and the connector pins, respectively, of the extension module, where they provide the same functionality. The connector pins may be integral with the power supply or they may be separate from the power supply. Thereby, the power supply may be connected electrically to the extension module using the trenches of the extension module and connector pins as defined above.

The composite board may have any shape as desired as long as it comprises the at least two layers, i.e. the anode layer and the cathode layer, of electrically conducting material separated by the electrically insulating material. The anode layer and cathode layer are separated by an insulator of electrically insulating material. In the context of the invention the term "separate" and its derived forms mean that direct electrical contact between the anode layer and the cathode layer is prevented in order to prevent short circuits between the anode layer and the cathode layer. The composite board may comprise additional elements as desired in order to separate the anode layer and the cathode layer, or the insulator of the electrically insulating material may be the only element separating the anode layer and the cathode layer.

The size of the composite board may be selected freely. In general, the composite board has a thickness reflecting the thickness of the insulator, e.g. in the form of an electrically insulating layer, plus the two electrically conducting layers. The thickness of the composite board is typically in the range of 2 mm to 50 mm. The other two dimensions will typically reflect the intended use of extension module, e.g. as a lighting fixture, and in a certain embodiment the composite board has a size according to recognised standards. For example, the composite board/lighting fixture may be sized to fit under e.g. a kitchen cabinet or the like. Thus, the lighting fixture may have a width of about 600 mm. The length, e.g. the length for a lighting fixture to fit under a kitchen cabinet, may be adjusted by cutting a section off so that the lighting fixture fits an intended number of cabinets. For example, the length may correspond to one or two kitchen cabinets, e.g. 600 mm or 1200 mm. Similar observations are relevant for the extension module not in the shape of a lighting fixture. In a certain embodiment the extension module or extension modules do not comprise any adapters with electronic components. For example, the only electronic components may be found in an electronic unit described above. In this embodiment it is preferred that the anode layer and the cathode layer are metallic and have been anodised, e.g. the anode layer and the cathode layer are made from aluminium or magnesium. In another embodiment the electrical supply system, and the corresponding extension module or extension modules, is (are) designed to replace a copper wire for supplying electricity to electronic components, and it has a width in the range of 10 to 100 mm, e.g. 30 mm to 50 mm, such as about 40 mm. In this embodiment the electrical supply system of the invention may also be referred to as a "rail"; a rail may contain modules, i.e. the extension modules, of a length in the range of 100 cm to 200 cm. Shorter lengths, e.g. 50 cm, are also possible. In particular, an extension module may be designed to connect two extension modules at an angle, and in this case the extension module may be short. In a particular embodiment the electrical supply system may comprise extension modules without any adapters which extension modules can supply electricity to further extension modules having adapters with electronic components or to one or more electronic units.

The anode layer of the composite board may be electrically connected to an anode of an electronic component, and the cathode layer of the composite board may be electrically connected to a cathode of the electronic component, but the anode layer and the cathode layer are otherwise not limited. The anode layer may also be referred to as a "first layer" and the cathode layer may also be referred to as a "second layer". Either of the anode layer or the cathode layer may represent a front layer or a back layer of the composite board, and thereby also of the electrical supply system or extension module. In the context of the invention the anode layer and the cathode layer may be referred to collectively as the "electrically conducting layers" or "conducting layers".

The composite board may be extending in two dimensions so that it can be described as "planar". A planar composite board is not limited with respect to thickness, and in general the thickness is defined by the combined thicknesses of the anode layer, the cathode layer and the insulator. The composite board may also be defined in three dimensions and e.g. have a shape representing a section of a sphere, e.g. a hemispherical shape, or an arch. Non-planar composite boards will also have a thickness that is defined by the combined thicknesses of the anode layer, the cathode layer and the insulator, and a non-planar composite board is also not limited with respect to its thickness.

The electrically conducting material may be chosen freely, and the conducting layers may be of any conducting material. Likewise, the conducting material may have any thickness as desired. However, it is preferred that the electrically conducting material comprises or is a metal. Preferred metals are metals selected from the list consisting of aluminium, magnesium, copper, titanium, steel, and their alloys. Metals may be anodised to provide the metal with an oxide layer on the surface, and in an embodiment the metal is anodised, e.g. by providing an oxide layer having a thickness of at least 10 μm. When the metal is anodised, the outer surface of the metal is electrically insulating so that an end user is protected from currents running through the electrically conducting materials, i.e. the anode layer and the cathode layer. Anodisation further protects the metal from being corroded. In particular, an electric current running through the anode layer or the cathode layer can make the metal more prone to corrosion but by anodising the metal such corrosion is prevented. Anodisation is especially relevant when the anode layer and/or the cathode layer is constructed from aluminium, magnesium or titanium, or alloys based on these metals. For example, these layers may be anodised to provide oxide layers of at least 10 μm thickness, e.g. about 20 μm $Al_2O_3$. Anodised aluminium, magnesium, or titanium has a protective insulating layer preventing short circuiting and electrical shocks.

In a specific embodiment the electrically conducting layers may be used to provide data communication with the electronic component using direct power line communication (PLC). In further embodiments, the extension module comprises additional electrically conducting layers, e.g. between the anode layer and the cathode layer. Additional electrically conducting layers may be used to provide communication to electronic components. When data communication is desired the composite board may be fitted with appropriate data ports, e.g. standardised ports, such as those known as USB, HDMI, Display Port, etc. When data ports are included, appropriate electronic components will typically also be integrated in the composite board. Data ports may be included in the extension module and also in the electronic unit when present.

In an embodiment the anode layer and/or the cathode layer is a sheet metal with a thickness up to 5 mm. e.g. in the range of 0.3 mm to 0.7 mm, or in the range of 0.5 mm to 2.0 mm. A preferred metal for the conducting layers is aluminium, e.g. in the form of sheets with a thickness up to 5 mm, e.g. in the range of 0.3 mm to 0.7 mm, or in the range of 0.5 mm to 2.0 mm. Likewise, sheets of magnesium or titanium are also relevant, and the thickness may be up to 5 mm, e.g. in the range of 0.3 mm to 0.7 mm, or in the range of 0.5 mm to 2.0 mm. In a specific embodiment the anode layer and/or the cathode layer is a sheet of copper, optionally coated with an electrically insulating material, e.g. lacquer or paint, on the surface opposite the surface in contact with the insulator.

The trenches each define a length axis, and it is preferred that the length axes of the trenches of the anode layer and the cathode layer are parallel. Parallel length axes of the trenches allow a standardised format for connecting the extension module with a further extension module or an electronic unit as defined above and also having trenches with parallel length axes. The locations of the trenches in the connection surface and the distance between them will correspond to those of any extension module for connecting to the first extension module. However, in an embodiment the extension module has a first connection surface with one set of locations and distance between the trenches and second connection surface with another set of locations and distance between the trenches. Thereby a directional system is achieved where extension modules will be connected according to a predetermined direction. In another embodiment all connection surfaces of both the first extension module and all further extension modules have identical locations of the trenches.

In an embodiment the anode layer and/or the cathode layer has been extruded from a metal, e.g. from aluminium, magnesium, copper, titanium, or steel. In a preferred embodiment the trench is formed in the extrusion process. For example, the trench may be present along a longitudinal axis of the respective layer through the length of the layer. Extrusion of the anode layer and/or the cathode layer is advantageous since it allows manufacture of the respective layer with the trench formed in the extrusion process so that a cheaper process is provided compared to providing a sheet metal or similar and creating the trenches in the layers. Likewise, extrusion allows preparation of an anode layer and/or a cathode layer having a non-uniform thickness. In a preferred embodiment the anode layer and the cathode layer are extruded, e.g. from aluminium or magnesium, to have a cross-section in a plane normal to the longitudinal axis of the respective layer, which cross-section defines a connecting region housing the trench and an adapter region in contact with the insulator of electrically insulating material. The adapter region will generally be thinner than the connecting region, which is sized to contain the trench. Thereby a more robust and flexibly module is provided, since the thickness of the adapter region can be smaller, e.g. having a thickness in the ranges of 0.2 mm to 1 mm, than the thickness of the connecting region, e.g. having a size in the range of 1 mm to 10 mm, e.g. 2 mm to 5 mm, leaving more room for the trench and any connection element. For example, the overall thickness of the composite board may correspond to the combined thickness of the adapter regions of the anode layer and a cathode layer and the thickness of the insulator, e.g. the combined thickness is in the range of 1 mm to 10 mm, e.g. 3 mm to 5 mm, so that the trench may have cross-sectional dimension of e.g. 2 mm to 4 mm. In a specific embodiment the anode layer and the cathode layer are rotationally symmetrical with respect to the connecting regions relative to the normal plane. In particular, the anode layer and the cathode layer may be rotationally symmetrical and have covered trenches, e.g. as may be prepared by extrusion. In this embodiment the anode layer and the cathode layer may advantageously be identical so that manufacture of the extension module is simplified. It is also possible that the anode layer and/or the cathode layer are manufactured by extrusion of a polymer material, e.g. a thermoplastic polymer, which is subsequently coated with a metallic layer to make the layer electrically conducting. In particular, the metallic coating will be between the extruded polymer and the insulator in order to prevent direct contact of an end user with the electrically conducting layers.

The insulator may have any form desired and the electrically insulating material may be any electrically insulating material. It is preferred that the insulating material comprises a flame retardant material. In an embodiment the insulator has the form of a sheet between the anode layer and the cathode layer, which may also be in the form of sheets, or which may be extruded to have another form. When the insulator has the form of a sheet its area generally corresponds to at least 50% of the area of the anode layer and/or the cathode layer. The insulator may also define a honeycomb structure or another discontinuous structure. For example, the insulator may take the form of a plurality of pillars or the like between the anode layer and the cathode layer. A plurality of pillars is especially preferred when the electrically conducting layers have been extruded.

The electrically insulating material is preferably a polymeric material. The electrically insulating material may be of low density. For example, the electrically insulating material may comprise an expanded or foamed material (open and/or closed celled), such as expanded polystyrene, and/or a reinforced material such as a fibre glass material. The electrically insulating layer may be made of a polymer material such as amorphous plastic materials (e.g. polyvinylchloride, polycarbonate and polystyrene) or crystalline plastic materials (e.g. Nylon, polyethylene and polypropylene), or wood. In a certain embodiment the electrically insulating material is polyethylene or the like and has a thickness of at least 0.2 mm, e.g. in the range of 1 mm to 6 mm, e.g. 3 mm or 5 mm. A specific composite board is marketed as a Dibond® plate. When the electrically insulating layer is made from wood it will generally be thicker, e.g. in the range of 10 mm to 20 mm. In a certain embodiment the insulator comprises several different materials. It is significant that the insulator separates the anode layer from the cathode layer in order to prevent short circuits, and it is possible that the insulator comprises an electrically conducting material as long as the anode layer is separated from the cathode layer. For example, the insulator may comprise a core of a different material, even a metal, providing strength and rigidity. In a further embodiment the insulator comprises materials of different thermal expansion coefficients so that the assembly of the insulator under increased temperature can provide a material of greater rigidity than expected from the individual materials. The same can be observed for the assembly of the extension module when it comprises a thermoplastic polymer as insulator.

In an embodiment the anode layer and the cathode layer, which may be extruded metals, are glued together with an electrically non-conducting glue so that the glue is the insulator. This allows a thinner layer of the insulator, e.g. in the range of 0.2 mm to 0.5 mm, since the insulator can be applied in a liquid form, e.g. at ambient temperature, so that the total thickness of the extension module is thinner than can be achieved using a solid material as insulator. It is preferred when the insulator is a glue that the hole for the adapter is made in the anode layer or the cathode layer as desired before gluing the electrically conducting layers together.

The composite board has a connection surface. The connection surface allows that the extension module is brought into electrical contact with a another extension module as defined above. In particular, the anode layer of the composite board of the first extension module is brought into electrical connection with the anode layer of the another extension module and the cathode layer of the composite board of the first extension module is brought into electrical connection with the cathode layer of the another extension module. In general, the another extension module may comprise any feature of any embodiment of the first extension module, but the another extension module does not have a power supply. In a specific embodiment the composite board has two connection surfaces with one connection surface at each end of the composite board. However, more complex designs of the composite boards are also contemplated where the composite board has multiple connection surfaces, e.g. one or two connection surfaces at the ends of the composite board with additional connection surfaces at a side of the composite board.

The connection surface may have any angle with respect to the composite board, which allows electric connection with a another extension module. Thus, the connection surfaces of the composite boards of the respective first and further extension modules typically have angles allowing contact between the connection surfaces. For example, the electrical connections may be provided by bringing the electrically conducting material of the respective layers into direct contact. In a certain embodiment the connection surface defines a plane, which is normal to a longitudinal axis of the respective composite boards. In another embodiment the connection surface defines an angle for connecting to a another extension module having a connection surface of a matching angle in order to provide a desired angle between the first extension module and the another extension module. For example, the first extension module may have a connection surface at an angle of 45°, e.g. 45° to the longitudinal axis in any plane, for connecting to a another extension module also having a connection surface at an angle of 45° in order to connect the first extension module and the another extension module at an angle of 90°.

The anode layer and the cathode layer each have a trench extending from the connection surface. The trenches allow connection, e.g. a securing connection, between the composite boards of the first extension module and a another extension module. The trench may have any shape as desired. For example, the trench may have a rectangular cross-section or the cross-section may have the form of a full circle or any section of a circle, e.g. a semicircle. The trench or trenches may be open to either surface of the anode layer or the cathode layer or the trench may be covered. For example, the trench may have an open side facing a surface of the anode layer or the cathode layer as appropriate or a trench may extend from the connection surface, e.g. be drilled into the anode layer or the cathode layer, so that the trench is enclosed in the electrically conductive material of the anode layer or the cathode layer, as appropriate. In a specific embodiment the anode layer and/or the cathode layer has been extruded, e.g. from a metal, such as aluminium, magnesium, copper, titanium, steel, and their alloys, to have a trench, which is only open to the connection surface, i.e. the trench is "covered". This advantageously minimises penetration of humidity into the extension layer. Furthermore, this embodiment allows more simple manufacture of an extension module with greater flexibility with respect to its design and appearance.

It is preferred that each trench comprises a connection element for engaging with a complementary connection element of a connector pin. In the context of the invention the term "engage" and its derived forms mean that a connection element is fastened to its complementary connection element; the fastening may be permanent, e.g. so that separation of the connection element and its complementary connection element will result in destruction of the connection element and/or the complementary connection element, or the engagement may be a releasable fastening, e.g. so that separation of the connection element and its complementary connection element will not affect future use of the connection element and its complementary connection element. Likewise, in the context of the invention a "connector pin" can connect a first extension module of the invention with a another extension module, e.g. in the electric supply system of the invention, to provide a permanent or releasable fastening of the first extension module to a another extension module. When the electrical supply system comprises a single extension module each trench of the anode layer and the cathode layer may comprise a connector pin. However, the anode layer and the cathode layer may comprise further trenches, and the electrical supply system need not comprise a connector pin for every trench. When the electrical supply system comprises multiple extension modules it will generally comprise a set of connector pins for each pair of extension modules so that each pair of extension modules can be connected via the connector pins at the connection surface.

The connector pin has complementary connection elements for engaging the corresponding connection elements of the trenches of the respective modules, and it may be designed freely. However, it is preferred that the connector pin is rigid in order to securely connect the first extension module and the another extension module. The connector pin will generally have a length in the range of 5 mm to 50 mm, e.g. 10 mm to 25 mm, and the trenches will have lengths to fully accommodate the connection pin. The cross-section of the connector pin may be round or square and have a cross-sectional dimension in the range of 1 mm to 10 mm, e.g. 2 mm to 5 mm. The connector pin may have a linear shape or it can comprise an angle between two linear sections. Regardless of the shape of the connector pin, the connector pin may comprise a flexible link between the first complementary connection element and the second complementary connection element, e.g. so that the section having the first complementary connection element is flexibly linked to the section having the second complementary connection element. A flexible link between the first and the second complementary connection element generally allows fitting the first extension module with the another extension module at an improved tolerance than can be obtained using a rigid, e.g. a rigid linear or a rigid angled, link. The flexible link may be elastic or it may be soft with low elasticity. When the flexible link has low elasticity or is soft it is preferred that the electrical supply system comprises a coupling device.

In a certain embodiment the connector pin is integral with the composite board or the electronic unit or the power supply. An integral connector pin will have a complementary connection element for engaging the connection element of the trench of the composite board of a another extension module and it will be in electrical connection with the anode layer or the cathode layer, as appropriate. In a further embodiment the connector pin is separate from the composite board. In the context of the invention an integral connector pin is part of the extension module, e.g. it is part of the anode layer or it is part of the cathode layer. In general, an integral connector pin cannot be removed from its layer without destroying the layer and thereby the extension module. A connector pin that is separate from the extension board may be moved freely between trenches to provide electrical connections between a first and a another extension module. The power supply and the electronic unit, when present, may also have integral connector pins or the connector pins may be separate from the power supply and/or the electronic unit. In a specific embodiment the extension module, e.g. the first extension module or a another extension module, may have a first connection surface with trenches as described above for electrically connecting via separate connector pins or integral connector pins of a another extension module, an electronic unit or the power supply and a second connection surface with integral connector pins for connecting electrically with a another extension module or an electronic unit.

In general, two connector pins are employed for each connection surface between an extension module and a another extension module, and the two connector pins for the same connection surface are typically identical. However, a connection surface may comprise further trenches and a corresponding number of connector pins. When the connector pins have an angle it is possible to connect the first extension module and the another extension module at the angle of the connector pin. The trenches may follow the longitudinal direction of the electrically conducting layers, so that the angle of the connector pins will correspond to the angle between the first extension module and the another extension module. In an embodiment the complementary connection element of the connector pin comprises one or more lengthwise springs that bulge outwards from the connector pin and press against the walls of the trench, optionally fitted with ridges, or against the inner surface of a hollow metallic cylinder serving as a connection element, thereby improving the electrical contact and preventing the connector pin from falling out and securing the connection between the first extension module and the another extension module. A connector pin with one or more lengthwise springs may also be referred to as a "banana connector", and any design of banana connector as known to the skilled person may be employed in the present invention. In an alternative embodiment the trench is fitted with one or more lengthwise springs that bulge outwards from the wall of the trench to provide the connection element. In this embodiment it is preferred that the connector pin comprises ridges, e.g. ridges transverse to a length axis of the connector pin, for securing connection between the trench and the connector pin. When a connection element comprises lengthwise springs, ridges on the complementary connection element may matches with the lengthwise positioning of the bulge or bulges of the spring and likewise when lengthwise springs are employed in the trench.

It is preferred that the connector pin comprises, or consists of, an electrically conducting material and that the electrical connection between the layers of the first extension module and a another extension module is provided via the connector pin. It is especially preferred that the connector pin is made of metal, e.g. brass, and has one or more lengthwise springs, e.g. also of brass, that bulge outwards from the connector pin.

In an embodiment the connection element is provided as opposite walls of the trench with a polygonal, e.g. rectangular, or circular cross-section, and the complementary connection elements of the connector pin may be a spring or elastic section providing a press-fit between the connector pin and the trench, e.g. the walls of the trench. The trenches of the composite board of a another extension module may also have connection elements for engaging with a connector pin with complementary connection elements. Thus, the first extension module or the another extension module may comprise a connector pin for each trench of the extension module, each connector pin having a first complementary connection element for engaging the connection element of the trench of the composite board of the first extension module and a second complementary connection element for engaging the connection element of the trench of the composite board of the another extension module. Thereby the another extension module is securely connected to the first extension module.

In an embodiment the trench or each trench comprises a ridge extending along a wall of the trench. The ridge may follow the length axis of the trench, or the ridge may have another orientation. For example, when the anode layer or the cathode layer have been manufactured by extrusion the ridge may be formed during the extrusion process. The ridge may have any shape and size as deemed appropriate. For example, the ridge may have a triangular cross-section, relative to the length axis of the trench. The ridge will typically have a "height" or protrusion from the wall of the trench in the range of 0.1 mm to 1 mm. The ridges may constitute connection elements for engaging with a complementary connection element of a connector pin. For example, the ridges may be angled, e.g. at a right angle, to the length axis of the trench to thereby form barbs for engaging with the complementary connection element of a connector pin, which may comprise a spring or an elastic section. In a certain embodiment the trench has a polygonal cross-section relative to the length axis of the trench, and the trench has a ridge on each wall of the trench as defined by the polygonal shape, the ridge or ridges following the length axis of the trench. For example, the trench may be open to either surface of the respective layer and have a rectangular, e.g. square, cross-section, with a ridge following the length axis of the trench on each wall of the trench so that the trench has opposed ridges. Likewise, the trench may be open to either surface of the respective layer and have a cross-section corresponding to a section of a circle with two or three ridges following the length axis of the trench on the wall of the trench.

In an embodiment the connection element is a hollow metallic cylinder with an outer helical thread. The outer helical thread may be screwed into the trench so that tight electrical contact is established between the hollow metallic cylinder and the electrically conducting material of the anode layer or the cathode layer having the trench. A hollow metallic cylinder is especially appropriate when the electrically conducting material is a metal. The outer diameter of a hollow metallic cylinder will correspond to, e.g. be equal to or slightly larger or smaller than, a cross-sectional dimension of the trench. The hollow metallic cylinder has an inner diameter corresponding to the size of, e.g. being equal to or slightly larger than, the cross-sectional dimension of a connector pin. In a particularly preferred embodiment the electrically conducting material is anodised aluminium, magnesium or titanium, and the trenches have ridges, e.g. as obtainable by extrusion of the anode layer or the cathode layer, and the connection element is a hollow metallic cylinder with an outer helical thread. It is especially preferred that the trench, e.g. being open to either surface of the respective layer, has at least three ridges along the length axis of the trench with the tips of the ridges being placed on the perimeter, e.g. distributed evenly on the perimeter, of a circle defined in a plane normal to the length axis of the trench. When the hollow metallic cylinder, e.g. having a diameter slightly larger than the diameter defined by the trenches, where the outer helical thread is screwed into the anodised metal, e.g. having an oxide layer of at least 10 μm, the oxide layer is more easily penetrated by the metal of the hollow metallic cylinder since the outer helical thread only has to penetrate the oxide layer at the much smaller surface of the ridge(s), e.g. three ridges, as compared to penetrating the larger surface of the wall of the trench. Thus, when the anode layer or the cathode layer is anodised aluminium, magnesium or titanium, and the trenches have ridges following the length axis of the trenches a hollow metallic cylinder with an outer helical thread as the connection element together provide a better electric contact to the connector pin, since the outer helical thread will penetrate the oxide layer when the hollow metallic cylinder is screwed into the trench. A preferred metal for the hollow metallic cylinder is brass or steel coated with nickel, brass, steel or copper, optionally coated with gold or silver. Especially the inner surface of the hollow cylinder may be coated with gold or silver.

The electric supply system may comprise any number of extension modules as defined above and/or any number of electronic units as defined above. In addition to the connector pins the electric supply system may also comprise one or more coupling devices. The coupling devices can provide further stability to the electric supply system. The coupling device of the electric supply system may take any form allowing appropriate connection between sections of the system, e.g. between a first extension module and a another extension module. In general, the coupling devices connect the first and the another extension module, and the connection may also include electrical connections so that the first electrically conducting layer of a first section is connected with the first electrically conducting layer of a second section and the second electrically conducting layer of the first section is connected with the second electrically conducting layer of the second section.

The coupling devices may be made from any material and may comprise an electrically conducting material for establishing electrical connections between the appropriate layers. For example, the coupling devices may be made of a polymeric material and have a metallic coating or layer for establishing electrical connection, or the coupling devices may be metallic. In an embodiment of the invention the coupling device is made of a polymeric material having a metallic resilient layer between the polymer material and the lighting fixture of the invention. The metallic resilient layer provides both electrical connection between an extension module and an adjacent extension module and also a structural function where the resilience holds the three components, i.e. the first extension module, the adjacent extension module and the coupling device, in place. The coupling devices may also be designed so as to create a direct electrical connection between the electrically conducting layers of two sections. In general, the coupling devices are designed to connect two sections at a specified angle, which may be chosen freely. In certain embodiments the lighting fixture system or the lighting fixture kit are based on planar composite boards, and the coupling devices can be a corner bracket, e.g. for connecting two sections at a specified angle, such as 90°, a straight bracket for connecting two sections in a straight line, or a T-bracket for connecting a first composite board to a mid section of a second composite board. The coupling devices can also connect sections in other dimensions than a plane, e.g. a plane of a first section. For example, different sections, e.g. planar sections, may be connected in different planes or dimension.

It is also contemplated that the extension module is provided with a power supply that is not limited to providing a constant current or a constant voltage. For example, a complete system may be designed with a specified set of electronic components in the composite board or in several composite boards when a another extension module is included in the design. However, this embodiment does not have the flexibility of the preferred embodiments of allowing additional electronic components to be added freely to the system or removing electronic components.

In an embodiment the extension module, and also any another extension module employed, comprises a plurality of adapters as defined above. The electronic component may be chosen freely, and for example the electronic component is selected from the list consisting of a light emitting diode (LED), a series of LED's, a resistor, a transistor, a controller, a chip on board (COB), a driver, a microphone, a camera, a sensor, a radio transmitter, a radio receiver, an antenna, an access point for wireless communication, e.g. WiFi, LiFi, Bluetooth, etc. Regardless of the nature of the electronic component, the adapters housing the electronic components are in parallel electric connection in the extension module and in any further extension modules connected to the first extension module. The same electronic components are relevant for an electronic unit when employed in the electrical supply system.

The adapter may be any adapter capable of being mounted in a hole in the composite board as defined above and thereby establishing electrical connection between the conducting layers and the anode and the cathode as described above. The adapter may comprise a retaining element corresponding to a section of the perimeter of the hole or the whole perimeter of the hole. A retaining element is especially suited when the hole is provided in a pre-assembled composite board, e.g. in the form of a dibond plate. However, the hole may also be established in each of the layers, e.g. in the anode layer and the insulator before assembly of the layers. When the hole has been established prior to assembly of the layers, the retaining element is generally not needed. In particular, the holes in the anode layer (or the cathode layer, as desired) and the hole in the insulator may be sized so that the hole in the insulator is larger than the hole in the anode or cathode layer thereby providing a retaining function. For example, the retaining element may be designed so that the adapter can be press fitted into the hole, or the hole and the retaining element may comprise complementary engagement means. Complementary engagement means may be an external thread on the retaining element and a corresponding internal thread in the hole. In an embodiment, a hole, e.g. round, square, or rectangular, is provided in the anode layer or the cathode layer as desired, and the electrically conducting layers are aligned with an insulator having a larger hole than provided in the respective conducting layer. This allows positioning of a circuit board having a larger dimension than the hole in the conducting layer before assembly of the extension module so that the circuit board is retained by being larger than the hole. For example, the circuit board may be glued to the back layer. The bottom layer, either the cathode layer or the anode layer as appropriate, may also comprise a hole of a size and shape corresponding to the hole in the insulator, but which hole does not fully penetrate the bottom layer. This allows for an adapter which is thicker than the insulator.

The adapter may also be soldered or glued to the composite board. The retaining element may be made of a polymer or a metal or a combination of a polymer and a metal. The adapter may comprise any other component or element as appropriate. In a certain embodiment the adapter may be removably fitted in the hole. In another embodiment the adapter is permanently fitted in the hole meaning that its removal will destroy the adapter.

The hole preferably has a round perimeter but it may also have a square or rectangular perimeter, or a perimeter of another shape. The hole may have any appropriate size, but in a certain embodiment the hole has a first dimension in the range of 5 mm to 50 mm, and a second dimension in the range of 5 mm to 50 mm. For example, the hole may be round and have a diameter in the range of 5 mm to 50 mm. The hole may also be larger, e.g. having a diameter up to or at 100 mm.

In its simplest form the adapter comprises the circuit board, e.g. a printed circuit board (PCB), and any element necessary to establish the electrical connections. For example, the hole in the composite board may go through the front layer, whether this is the anode layer or the cathode layer, and the insulator but not the back layer so that the back layer forms a support for the circuit board, which is glued to the back layer. It is preferred that the glue, e.g. in a layer of a thickness in the range of 50 μm to 100 μm, is both electrically and thermally conducting so that the gluing establishes the electrical connection from the electronic component to the back layer and further leads excess heat away from the electronic component. This is especially advantageous when the electronic component is a LED and the back layer is aluminium. Electrical connection from the front layer to the circuit board may be established using an electrically conducting element, e.g. a resilient element in press between the front layer and the circuit board. The circuit board may be any component capable of carrying the electronic component and establishing electrical connection from the first layer to an anode of the electronic component and electrical connection from the second layer to a cathode of the electronic component. The circuit board is not limited to a "board" shape and is defined solely by the functions outlined above. In its simplest form the "circuit" of the circuit board provides electrical contacts between the anode and the cathode of the electronic component and the two conducting layers, respectively. The circuit board may be any kind of material, e.g. plastic, metal etc., provided with the circuit for transmission of electricity. The circuit may be attached to the circuit board in any way, e.g. by printing, soldering, gluing or the like. In a certain embodiment the circuit board is a PCB.

It is particularly preferred that the electronic component is a LED or a series of LED's. When the extension module comprises a plurality of LED's or a plurality of series of LED's the extension module may also be referred to as a lighting fixture.

By connecting the LED's in parallel in the composite board and supplying power at a constant voltage via the conducting layers a lighting fixture is provided with flexibility to allow removal or addition of LED's and also physically adjustment of the size of the lighting fixture as desired. For example, a lighting fixture containing e.g. 20 LED's may be adjusted in size, e.g. by cutting, as desired, for example to fit under a kitchen cabinet or the like. When one or more LED's are removed from the lighting fixture, e.g. by cutting off a section of the lighting fixture containing one or more LED's, the conducting layers will ensure that power is supplied to the remaining LED's and the constant voltage will ensure that each LED receives the necessary current to drive the LED. Supplying power via the conducting layers removes the need for separate wiring to each LED providing a simple system. It is also advantageously possible to add additional LED's to a lighting fixture. For example, a hole can be established in a lighting fixture and an adapter as defined above can be inserted in the hole. Power will be supplied to the inserted LED via the conducting layers and the constant voltage will ensure that the original LED's in the composite board and the inserted LED receive an appropriate current to drive the LED's.

Correspondingly it is also possible to couple a lighting fixture of the invention with further composite boards, or extension modules, carrying LED's In yet a further aspect the invention relates to a method of producing an extension module, e.g. a lighting fixture, the method comprising providing an extension module of the invention having a plurality of adapters and removing a section of the composite board, the section containing one or more of the adapters, which removal leaves the circuit board of at least one adapter in electrical connection with the power supply. The extension module produced according to the method will have fewer adapters with electronic components, e.g. LED's or series of LED's, than the initial lighting fixture but since a constant voltage or constant current is supplied via the conducting layers each remaining electronic component is supplied with an appropriate current or voltage, and all advantages of the extension module are obtained for the produced extension module. The method is especially relevant when the extension module is a lighting fixture, in particular the lighting fixture aspect of the invention. In yet a further aspect the invention relates to a method of producing an extension module, e.g. a lighting fixture, the method comprising providing an extension module of the invention, providing one or more adapters, each adapter comprising a circuit board carrying an electronic component, e.g. a LED or a series of LED's, the adapter being designed to fit in a hole extending entirely through or partly through the composite board and by fitting in the hole establishing electrical connection from the first layer to an anode of the electronic component and electrical connection from the second layer to a cathode of the electronic component, establishing a hole extending entirely through or partly through the composite board, fitting the adapter in the hole.

In yet a further embodiment the invention relates to a method of producing a lighting fixture, the method comprising providing a composite board comprising at least two layers of electrically conducting material comprising a first layer and a second layer that are separated by at least one insulator of electrically insulating material, providing one or more adapters, each adapter comprising a circuit board carrying an electronic component, being a LED or a series of LED's, the adapter being designed to fit in a hole extending entirely through or partly through the composite board and by fitting in the hole establishing electrical connection from the first layer to an anode of the electronic component and electrical connection from the second layer to a cathode of the electronic component, providing a power supply capable of providing a constant voltage between the first layer and the second layer, establishing a hole extending entirely through or partly through the composite board, fitting the adapter in the hole, and electrically connecting an anode of the power supply to the first conducting layer and a cathode of the power supply to the second conducting layer. In the methods of the invention it is preferred that the holes fit the adapter.

The circuit board carries an electronic component, which may comprise or be a LED or a series of LED's. The LED preferably has the form of a surface mounted device (SMD). In a series of LED's the LED's are electrically serially connected on the circuit board. The LED may be any LED as desired. For example, the LED may provide light of a specific colour, or the LED may provide white light, e.g. of a colour temperature in the range of 1,500 K to 8,000 K. An adapter with white LED's will typically provide a luminous intensity in the range of from 50 lumen to 500 lumen, although the lighting fixture of the invention is not limited to adapters providing luminous intensities in this range. The "electronic component" is not limited to one component and further it is not limited to LED's. For example, the electronic component may also comprise a resistor, a transistor, a controller, a chip on board (COB), a driver, a microphone, a camera, a sensor, e.g. a sensor for temperature or humidity, etc. Other components are preferably also in a surface mounted form. When the electronic component comprises other entities than a LED these may be connected as desired, e.g. in series or in parallel with the LED or LED's. A LED will have a forward voltage ($V_f$) that is needed to power the LED and turn it on. In the context of the invention the electronic component is considered to have a combined forward voltage ($V_f$) for all components on one circuit board. Each adapter in a lighting fixture of the invention will generally have electronic components of the same nominal forward voltage ($V_f$). The forward voltage ($V_f$) may also be referred to as the threshold voltage.

LED's will have a nominal forward voltage ($V_f$) but the actual forward voltage ($V_f$) may vary between LED's with the same nominal forward voltage ($V_f$). If a number of LED's are connected in parallel and the actual forward voltages ($V_f$) vary between the LED's each LED will not be supplied with an optimal current resulting in different amounts of lumen produced from each LED despite it that the LED's are nominally identical. This problem can be minimised by connecting a series of LED's in each electronic component thereby statistically evening out the variation. It is therefore preferred that the electronic component comprises a series of 2 to 10 LED's. Similar observations are relevant also for other electronic components. The problem of variation in actual forward voltages ($V_f$) is especially pronounced for high power diodes, e.g. with power ratings above 1 W. When the LED's have a power rating in the range of 0.1 W to 1.0 W the problem of mismatches in actual forward voltage ($V_f$) will be minimal. In a preferred embodiment each electronic component comprises a series of 2 to 10 serially connected LED's with a power rating in the range of 0.1 W to 1.0 W. In a particularly preferred embodiment each electronic component comprises 2 to 6, e.g. 4, serially connected LED's with a power rating in the range of 0.2 W to 0.4 W. In this range of power rating the serially connected LED's will circumvent the problem of mismatching of actual forward voltages ($V_f$), and the same luminous intensity from each series of LED's is achieved. However, the LED's may also have a power rating higher than 1 W, e.g. in the range of 3 W to 10 W, or even higher than 10 W.

Another solution to the mismatching of actual forward voltages ($V_f$) can be provided by including a resistor, in particular an adjustable resistor, in series with the LED or series of LED's on the circuit board.

The lighting fixture of the invention comprises a single power supply capable of providing a constant voltage, i.e. a direct current, between the first layer and the second layer. The constant voltage is generally higher than the forward voltage ($V_f$) of the electronic components of the adapters. Thereby it is ensured that the power supply can power the electronic components. The constant voltage may be chosen freely depending on the forward voltage ($V_f$) of the electronic components. It is preferred to employ standardised constant voltages, e.g. 12 V or 24 V. It is further preferred that the electronic components of circuit boards have a forward voltage ($V_f$) in the range of 60% to 100% of the constant voltage of the power supply. For example, the electronic component may be a series of 4 LED's with a nominal $V_f$ of about 3 V so that the combined $V_f$ of the electronic component will be about 12 V.

The lighting fixture of the invention may also be set up to have a first adapter having a circuit board further comprising a transistor and optionally a resistor, which first adapter represents a reference point, and wherein each circuit board of the remaining adapters comprises a transistor, the adapters defining a current mirror based on the reference point. A current mirror is well known to the skilled person.

The lighting fixture of the invention may have any number of adapters as long as there is a minimum of two adapters.

When metallic electrically conducting layers are used in the composite boards the LED's may be in thermally conducting connection with the electrically conducting layers, and since metals are generally efficient thermal conductors the electrically conducting layers will provide a heat sink for the LED's. The heat sink functionality may also be relevant for other electronic components. Heat sinks are especially relevant when the LED's or series of LED's have power ratings or combined power ratings, respectively, of 1 W or more. Thereby, it is possible to position the adapters in close vicinity, e.g. within 20 mm, without risk of heat damaging the LED's. In a specific embodiment the LED, in particular as a SMD, is mounted on a thermal conductor component, which in turn is mounted on the circuit board. The thermal conductor component may also be referred to as a heat sink. The thermal conductor component serves to conduct heat away from the LED and eventually to the electrically conducting layers of the composite board. When the LED is mounted on a thermal conductor component it is further preferred that the circuit board is also metallic and thereby helps in conducting heat away from the LED's. The thermal conductor component may be any appropriate material, e.g. a metal, silicon carbide or another thermally conducting material or a combination of these materials. The thermal conductor component will typically have a superficial area equal to or larger than the superficial area of the LED, e.g. the SMD LED, and the thickness of the thermal conductor component may be in the range of 0.1 mm to 2 mm, e.g. 0.5 mm to 2 mm. By using a thermal conductor component, a lighting fixture is provided where heat generated by LED's is efficiently removed from the LED's. This improves the lifetime of the LED's and also provides greater freedom of positioning the LED's in the composite plate since the adapters can be positioned without concern of excessive heating in an area with closely positioned LED's, especially when the LED's have a combined power rating of 1 W or more.

The lighting fixture may further comprise a light processing layer on top of the electrically conducting layer with the LED's. The light processing layer may be a polymer panel or film, such as an opalised acrylic panel/film, a clear acrylic panel/film, an acrylic prismatic panel/film, a transparent or semitransparent coloured panel/film, a lens and/or an acrylic lens panel. The panel or film protects the electronic component e.g. from water and/or scatter and/or diffuse and/or focus light emitted from the electronic component. This is advantageous when the lighting fixture is for outdoor use or is a ceiling panel where a particular kind of light is desired for different applications such as lighting for office work, hall way lighting, operating room lighting etc. In a specific embodiment the adapter comprises a sealing making the lighting fixture water tight, especially when the lighting fixture also comprises a light processing layer. A sealing may also be employed in the extension module of the invention.

It should be understood that combinations of the features in the various embodiments and aspects are also contemplated, and that the various features, details and embodiments may be freely combined into other embodiments. In particular, it is contemplated that all definitions, features, details, and embodiments regarding the lighting fixture, the lighting fixture system, the lighting fixture kit, the electrical supply system, the extension module and the methods of producing a lighting fixture apply equally to one another. In particular, any feature mentioned in the context of the lighting fixture is equally relevant for the electric supply system and the extension module, especially when the respective modules comprise a plurality of LED's or a plurality of series of LED's.

Reference to the figures serves to explain the invention and should not be construed as limiting the features to the specific embodiments as depicted.

BRIEF DESCRIPTION OF THE FIGURES

In the following the invention will be explained in greater detail with the aid of an example and with reference to the schematic drawings, in which.

DETAILED DESCRIPTION OF THE INVENTION

The present invention relates to an electrical supply system 100, and to a lighting fixture, a lighting fixture system, a lighting fixture kit, and methods of producing an extension module 1 or a lighting fixture.

In a certain embodiment the extension module 1 does not comprise any adapters with electronic components. Preferably the electrical supply system 100 comprises a plurality of extension modules 1 and an appropriate number of connector pins for electrically connecting the extension modules 1. In the following the different features of the electrical supply system 100 are described with a focus on the features of the extension module 1 in the form of a lighting fixture, which employs light emitting diodes (LED) and can be used for general illumination. However, the features described are not limited to lighting fixtures but may be relevant for any embodiment. The lighting fixture provides flexibility for fitting into a spatially limited location by adjusting the size of the lighting fixture as desired. In the context of the invention the term "LED" may refer to a single LED or several, e.g. 2 to 10, serially connected LED's, unless otherwise noted. The LED is an example of an "electronic component" and the terms may be used interchangeably. However, an electronic component may also be another component than a LED. A LED will have a forward voltage ($V_f$) required to power the LED and make it produce light. The LED's are preferably white light LED's providing white light with a colour temperature in the range of 1,500 K to 8,000 K, e.g. in the range of 2,500 K to 3,000 K, or 2,700 K to 3,200 K, or 3,000 K to 3,500 K, or 3,500 K to 4,500 K, or 4,500 K to 6,000 K, or 6,000 K to 8,000 K. LED's are typically supplied with a nominal forward voltage ($V_f$) e.g. 3 V, but the actual $V_f$ of a LED may differ from the nominal $V_f$. For example, for a LED with a nominal $V_f$ of 3 V, the actual $V_f$ may vary with ±0.1 V when the LED has a power rating in the range of 1 W to 5 W or more (a "high power LED"), whereas a LED with a nominal $V_f$ of 3 V may vary with ±0.05 V when the LED has a power rating of less than 1 W (a "medium power LED"), e.g. a power rating in the range of 0.2 W to 0.4 W. It is therefore particularly advantageous that each adapter in the lighting fixture of the invention comprises a series of medium power LED's, e.g. 2 to 6 LED's with a power rating in the range of 0.2 W to 0.4 W, since the lower variation in actual $V_f$ compared to the nominal $V_f$ can reduce the problem of mismatching of actual $V_f$ values when the LED's are in parallel electrical connection.

Figure 1:
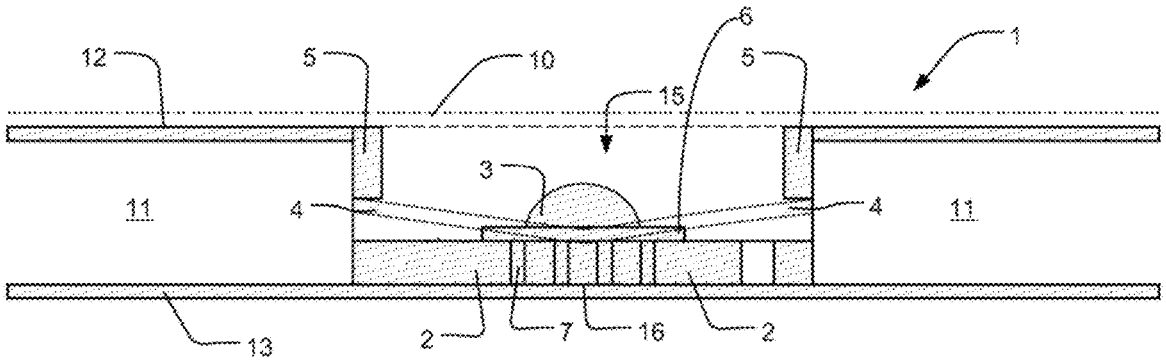
FIG. 1 shows a cross-sectional view of an adapter used in an extension module of the invention.
Figure 2:
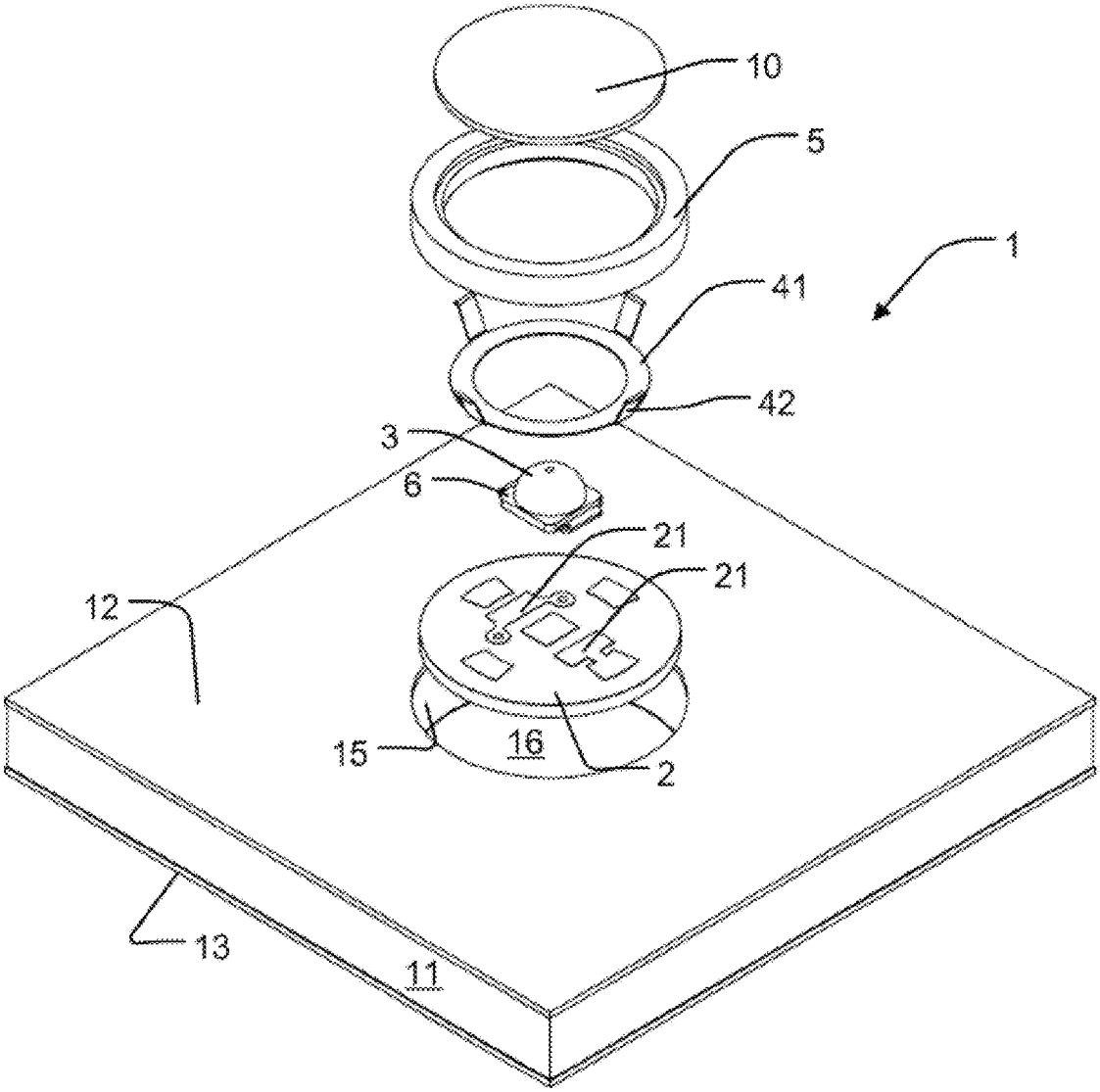
FIG. 2 shows an exploded view of an adapter used in an extension module of the invention.

Referring now to the figures, an embodiment of an adapter of the extension module 1, e.g. a lighting fixture, according to the present invention is depicted in a cross-sectional view in FIG. 1, and an embodiment of an adapter of a lighting fixture according to the present invention is depicted in an exploded view in FIG. 2. The LED may readily be replaced by other electronic components in the adapter.

FIG. 1 shows a part of an extension module 1, e.g. a lighting fixture, of an electrical supply system 100 of the invention. The composite board in this embodiment comprises an insulator 11 in the form of an electrically insulating layer, e.g. polyethylene, positioned between two electrically conducting layers 12,13. The electrically conducting anode layer 12 is shown as an "electrically conducting front layer", and cathode layer 13 is shown as an "electrically conducting back layer". It is also possible that the front layer is the cathode layer and that the back layer is the anode layer. The electrically conducting layers 12,13 are made of e.g. aluminium, but may be made electrically conducting by the use of other conducting materials. When aluminium is used it is preferably anodised, e.g. to have an oxide layer of about 20 μm thickness. The composite board is provided with a hole 15, in this case a cylindrical hole, through the electrically conducting layer 12 and the insulator 11. The hole 15 comprises a bottom 16 constituted by the electrically conducting back layer 13 and wall(s) constituted by the insulator 11 and the electrically conducting layer 12. The hole 15 may also have perimeters of other shapes, e.g. superficial shapes, such as square, rectangular, triangular perimeters etc. Inside the hole a circuit board 2, e.g. a printed circuit board (PCB), is provided. The circuit board 2 has the same shape and size, or slightly smaller size, than the bottom of the hole 15. It may also be even smaller, larger or a different shape. An electronic component 3, shown as a surface mounted device (SMD) LED is attached to the circuit board 2. Alternatively, another kind of LED can be used. The SMD LED 3 comprises a first and a second electrical terminal (not shown), functioning as the cathode and anode, respectively.

In the embodiment shown, the first electrical terminal is in a first electrical connection with the electrically conducting front layer 12, and the second electrical terminal is in second electrical connection with the electrically conducting back layer 13.

The first electrical connection between the electrically conducting front layer 12 and the first electrical terminal is formed via a conductor, preferably a printed conductor, on the circuit board 2 and further conductors as appropriate. In the embodiment shown, the first electrical terminal is in electrical connection with an electrically conducting element 4, e.g. a resilient electrically conducting element in the form of a wave spring, a washer ring, a spring washer, a disc spring or a coil etc., positioned along the circumference of the hole 15, which is further in electrical connection with an electrically conducting retaining element 5, extending along the circumference of the hole and between the electrically conducting front layer 12 and the electrically conducting element 4. The conducting retaining element 5 is especially appropriate when the hole 15 is made into a preformed composite board, e.g. a dibond plate. When the hole is established in one or both layers, in particular the "front layer", of a composite board before assembly of the composite board a conducting retainer element is typically not used. In a specific embodiment the electrically conducting element 41 is a metallic ring with one or more legs, e.g. 4 legs, providing resilience. The electrically conducting retaining element 5 may be a metal ring, e.g. a copper or aluminium ring, at the circumference of the circuit board 2. The electrically conducting element 4 is preferably made of a suitable metal e.g. spring metal, copper, an aluminium alloy etc. The electrically conducting element 4 is in press between the circuit board 2 and an electrically conducting retaining element 5 in the form of an, e.g. metallic, electrically conducting retainer ring, extending along the circumference of the hole and between the electrically conducting front layer 12 and the electrically conducting element 4. The electrically conducting element 4, e.g. in the form of a wave spring, is waved along the edge such that the edge of the wave spring alternately is in contact with the electrically conducting retaining element 5 and the circuit board 2. The electrically conducting retaining element 5 thus establishes an electrical contact to the electrically conducting front layer 12. The electrically conducting element 4 and the electrically conducting retainer ring 5 further keep the circuit board 2 in place. The circuit board 2, the electrically conducting element 4, and the electrically conducting retaining element 5 can be considered to constitute the adapter. In a specific embodiment the circuit board 2, the electrically conducting element 4, and the electrically conducting retaining element 5 are joined together for easy insertion of the adapter in the whole. In another embodiment the circuit board 2, and optionally the electrically conducting element 4, and the electrically conducting retaining element 5 are contained in a holder or the like, which holder can be inserted into the hole.

Alternatively, the electrically conducting element 4 may be dispensed with such that the electrically conducting retaining element 5 is in direct contact with the supply circuit on the circuit board 2. As a further alternative the electrically conducting front layer 12 may extend over the electrically conducting retaining element 5 such that the electrically conducting front layer 12 keeps the electrically conducting retaining element 5 in place, for example when the electrically conducting front layer 12 has been prepared by extrusion for subsequent assembly into the composite board.

The second electrical connection to the electrically conducting rear layer 13 is formed from the second electrical terminal via a conductor, preferably printed, on the circuit board 2 extending to a conductor mounted on, in or through the circuit board 2. In the embodiment shown, the conductor extends through a hole in the circuit board 2 to the electrically conducting rear layer 13. The conductor may take the form of an electrically conducting pipe, a cable or a rod, etc.

The adapter is furthermore provided with a thermal conductor component 6, e.g. of silicon carbide, on which the LED 3 is mounted, further comprising thermal conductors 7, in the form of copper threads, extending between the thermal conductor component 6 and the electrically conducting back layer 13 through the circuit board 2. Other heat conducting materials may be used as well.

Additionally, as all the components/elements in the hole may be flush with the surface of the electrically conducting front layer 12, i.e. there are no protruding parts extending beyond the surface of the electrically conducting front layer 12, an additional light processing layer 10 in the form of an acrylic plate or film is provided on top of the electrically conducting front layer 12. The light processing layer 10 may only cover the hole, for example if it is in the form of a recessed lens, or it may also be dispensed with. The light processing layer may be used for protecting the electronic component from water, e.g. together with a seal (not shown), and/or Ultra Violet (UV) light and/or scatter and/or diffuse and/or focus light emitted from the light emitting diode.

Further attachment means may be used to keep the adapter in place, such as an adhesive or paste that may be electrically conducting. Also an optical lens may be attached as the light processing layer 10 or be incorporated therein.

In the embodiment depicted in FIG. 2, the electrically conducting element has a base 41 and is provided with four conducting resilient legs 42 extending between the base 41 and an electrically conducting retaining element 5. Alternatively, the electrically conducting element 41 may be provided with an arbitrary number of legs such as three to six legs. FIG. 2 also shows a printed circuit 21 on the circuit board, e.g. in the form of an aluminium plate with a printed circuit. The aluminium secures a good thermal contact to the LED's thermal conductor component 6. The circuit board 2 is coated on the back side with a thin layer of gold to provide a good thermal and electrical contact to the bottom of the recess in the form of the electrically conducting rear layer 13. The gold coating may be dispensed with. The lighting fixture may also comprise, e.g. between the circuit board 2 and the electrically conducting back layer 13, a thermal paste to provide better thermal contact to thereby leading heat away from the LED and further to prevent corrosion of the electrically conducting back layer 13, e.g. when the electrically conducting back layer 13 is made from aluminium. When the lighting fixture comprises a thermal paste it may also comprise a thin toothed washer between the circuit board 2 and the electrically conducting back layer 13 in order to avoid electrical resistance from the thermal paste.

The length of the lighting fixture and any supplementary module may follow recognised standards. For example, for kitchen cabinets it may have a standard width of 600 mm so that the length of the lighting fixture and/or the supplementary module will also be 600 mm. It is also possible for the length to be a multiple of the standard value, e.g. 1200 mm or 1800 mm. Each adapter comprises 4 serially connected LED's with a combined nominal $V_f$ of about 11.6 V. The adapters are positioned at a distance from each other of 200 mm. The lighting fixture has been cut at a 45° angle and is connected to a supplementary module that has likewise been cut at a 45° angle so that the connection via the corner bracket provides a 90° angle between the lighting fixture and the supplementary module. The lighting fixture is supplied via a single 12 V constant voltage power supply 90.

Figure 3:
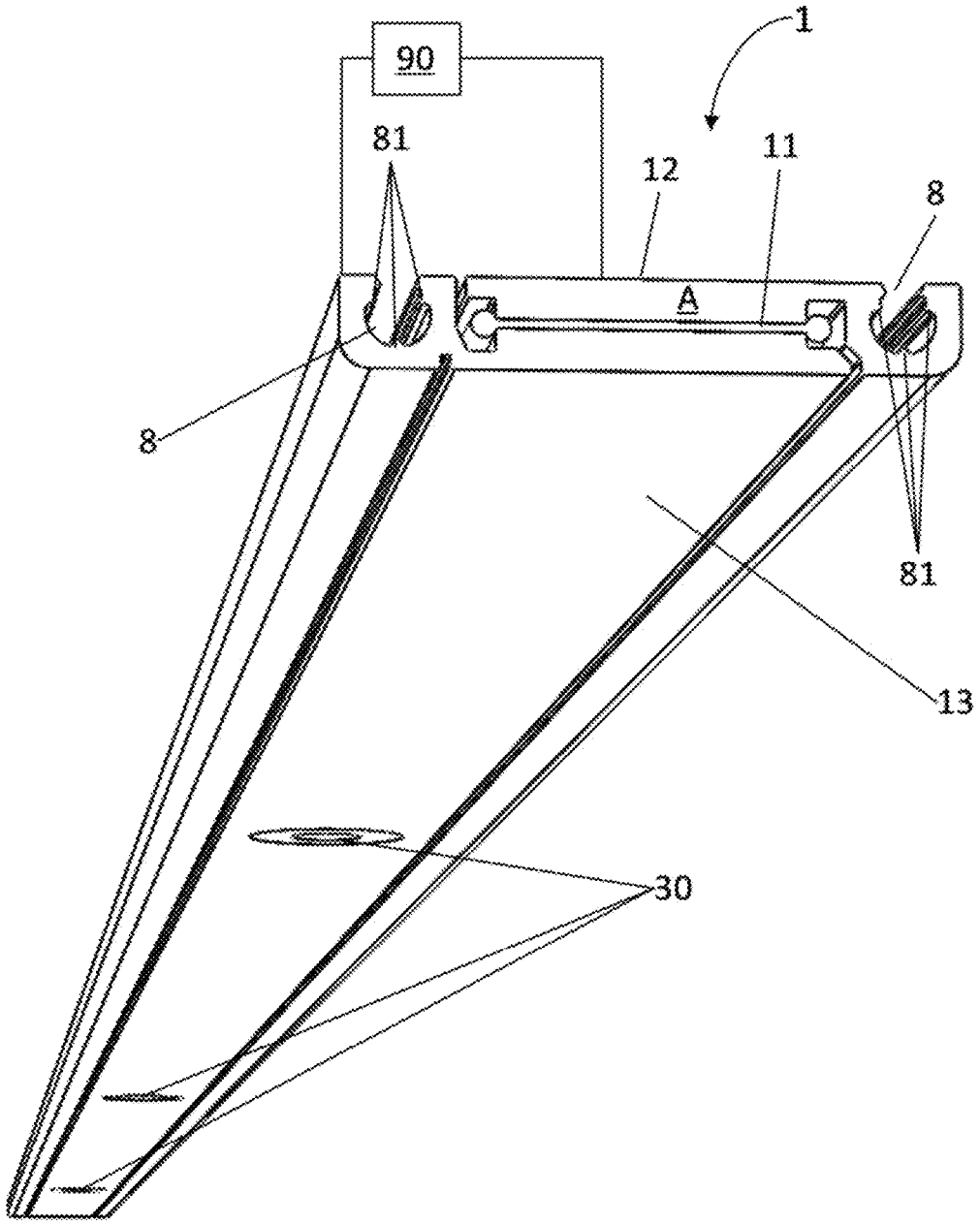
FIG. 3 shows a perspective view of an extension module of the invention.
Figure 4:
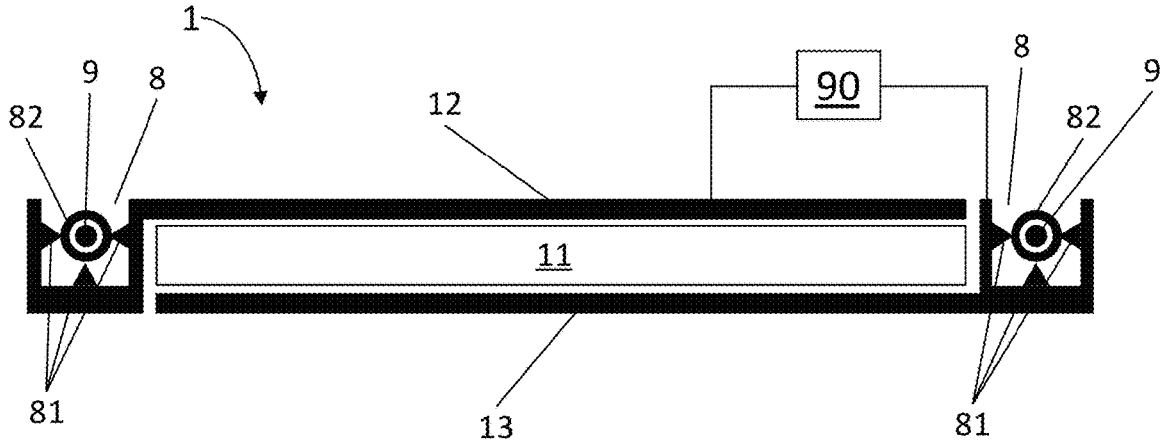
FIG. 4 shows an end view of an extension module of the invention.
Figure 5:
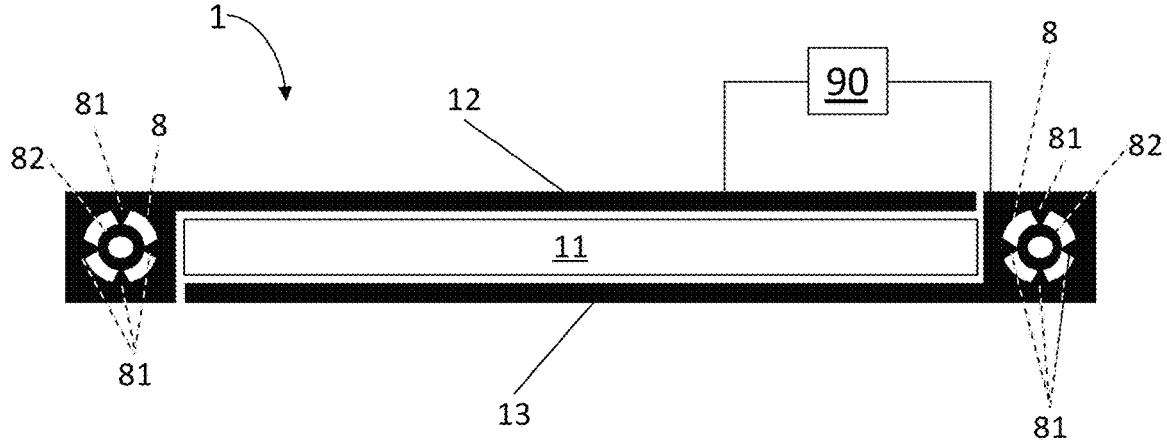
FIG. 5 shows an end view of an extension module of the invention.

A perspective view of an extension module 1 of the invention is illustrated in FIG. 3, and the connection surface of the extension module 1 is shown in FIG. 4. The trenches 8 illustrated in FIG. 4 are open at the surfaces of the cathode layer 13 and the anode layer 12, respectively. FIG. 5 illustrates an embodiment where the trenches 8 are covered. Specifically, the anode layer 12 and the cathode layer 13 in this embodiment have been extruded from aluminium, which has subsequently been anodised. The composite board of the extension module 1 comprises an anode layer 12 and a cathode layer 13 of anodised aluminium. The electrically conducting layers 12,13 have been prepared by extrusion so that the electrically conducting layers 12,13 each comprise a trench 8 along the longitudinal axes of the electrically conducting layers 12,13 through the length of the respective layers. The electrically conducting layers 12,13 have been assembled with an insulator 11 of polyethylene. The extension module 1 shown in FIG. 3 comprises a plurality of adapters 30; in the embodiment of FIG. 3 the adapters comprise LED's. The adapters are electrically connected in parallel in the extension module 1, which is fitted with a power supply 90 providing a constant voltage of 12 V. In another embodiment the constant voltage is 24 V. The electrically conducting layers 12,13 each have a trench 8 with three ridges 81 along the length axis of the trench 8. The trenches in FIG. 3 and FIG. 4 are open to a surface, e.g. the back surface, of the extension module 1. In FIG. 3 the trenches 8 have a circular cross-section with the ridges 81 defining a circle in the plane of the cross-section. In FIG. 4 the trenches 8 have a rectangular, e.g. square, cross-section with a ridge 81 on each wall, so that the three ridges 81 in this case also define a circle in the plane of the cross-section. In FIG. 5 the trenches 8 have a round cross-section. The connection surface A is in a plane, which is normal to the longitudinal axis of the electrically conducting layers 12,13, and the angle of the trenches 8 is normal to the same plane. FIG. 4 and FIG. 5 illustrate the extension module 1 seen from the connection surface A; the embodiments and their features depicted in FIG. 4 and FIG. 5 are not drawn to scale. Each trench 8 has a connection element 82 in the form of a hollow brass cylinder with an external helical thread (not shown). The brass cylinder has a diameter slightly larger than the circle defined by the tips of the three ridges 81 so that the brass cylinder can be screwed into the ridges 81 and penetrate the oxide layer thereby creating electrical connection from the respective electrically conducting layer 12 or 13 to the hollow part of the brass cylinder.

The extension module 1 is used with connector pins (not shown) having a first and a second complementary connection element allowing the first extension module 1 to be connected with a another extension module of the invention (not shown). It is preferred that the first extension module 1 and the another extension module have composite boards with trenches with identical connection elements so that these can be connected with a connector pin, e.g. a brass connector pin, having two identical complementary connection elements. The complementary connection elements may for example be banana connectors that can be inserted into the hollow part of the brass cylinders. However, in another embodiment the trenches of the first extension module 1 have different connection elements from the trenches of the composite board of the another extension module, and the connector pins have correspondingly different complementary connection elements. In yet a further embodiment the anode layers 12 employ one type of connection elements and complementary connection elements, and the cathode layers 13 employ a different type of connection elements and complementary connection elements. In a particularly preferred embodiment, the anode layers 12 and the cathode layers 13 cannot be connected using the same type of connector pins so that correct connection between the first extension module 1 and a another extension module is ensured.

The connection surface A is depicted at the end of the extension module 1. However, the connection surface A, or further connection surfaces, may be located along the side of the composite board. In an embodiment, the electrically conducting layers 12,13 are extruded from aluminium to each have a trench along the length of the electrically conducting layers 12,13, and further trenches can be provided at any location in the composite board in order to provide further connection surfaces, e.g. at a right angle to the longitudinal axis of the electrically conducting layers 12,13.

Figure 6:
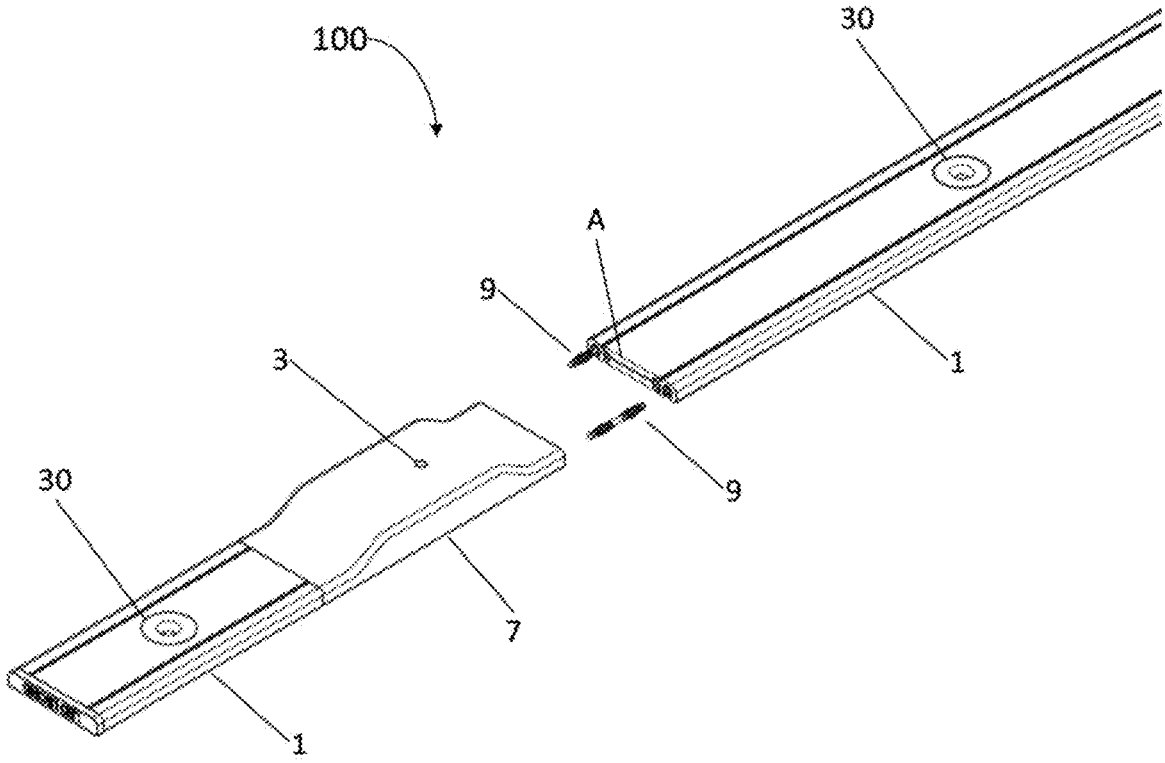
FIG. 6 shows a perspective view of an electrical supply system of the invention.

FIG. 6 shows a perspective view of an electrical supply system 100, which has two extension modules 1 and an electronic unit 7. The two extension modules 1 each have an adapter 30 with an LED (not shown), and the electronic unit 7 has an electronic component 3 in the form of a sensor. FIG. 6 shows the connection surface A of one extension module 1 where a connector pin 9 is inserted into one trench of the composite board of the extension module 1. The power supply 90 supplies a direct current to the extension module 1 on the right, and when this is connected to the electronic unit 7 the sensor 3 will be supplied with the direct current via the connector pins 9. The adapter 30 of the extension module 1 on the left is in turn supplied with the direct current via the electronic unit 7, which is likewise connected to the extension module 1 on the left via connector pins (not visible).

The invention claimed is:

1. An electrical supply system comprising:

an extension module comprising a composite board having an anode layer and a cathode layer of an electrically conducting material, which anode layer and cathode layer are separated by an insulator of an electrically insulating material, the anode layer and the cathode layer each having a trench extending from a connection surface of the composite board and comprising a connection element, connector pins for the trenches of the extension module, each connector pin having a first complementary connection element for engaging a connection element of a trench of a composite board of another extension module and a second complementary connection element for engaging the connection element of the trench of the composite board of the extension module, the connector pin comprising an electrically conducting material for providing electrical connection between the anode layers of the extension module and said another extension module or between the cathode layers of the extension module and said another extension module, or wherein the electrically conducting material is for providing electrical connection between the anode layer or the cathode layer of the extension module and the electronic unit, a power supply capable of providing a constant voltage or a constant current between the anode layer and the cathode layer, and wherein the connection element is a hollow metallic cylinder with an outer helical thread.

2. The electrical supply system according to claim 1, wherein the connector pin is integral with the composite board or separate from the composite board.

3. The electrical supply system according to claim 1, wherein the electrically conducting material is a metal selected from the list consisting of aluminium, magnesium, copper, titanium, steel, and their alloys.

4. The electrical supply system according to claim 3, wherein the metal has been anodised.

5. The electrical supply system according to claim 3, wherein the anode layer and/or the cathode layer has been extruded from the metal.

6. The electrical supply system according to claim 1, wherein the trench is open to either surface of the anode layer or the cathode layer or wherein the trench is covered.

7. The electrical supply system according to claim 1, wherein the electrical supply system comprises a plurality of extension modules.

8. The electrical supply system according to claim 1, wherein the extension module comprises an adapter for mounting in a hole extending entirely through or partly through the composite board, the adapter comprising a circuit board carrying an electronic component, the circuit board establishing electrical connection from the anode layer to an anode of the electronic component and electrical connection from the cathode layer to a cathode of the electronic component.

9. The electrical supply system according to claim 8, wherein the electrical supply system comprises a plurality of adapters.

10. The electrical supply system according to claim 8, wherein the electronic component is selected from the list consisting of a light emitting diode (LED), a series of LED's, a resistor, a transistor, a controller, a chip on board (COB), a driver, a microphone, a camera, a sensor, a radio transmitter, a radio receiver, an antenna and an access point for wireless communication.

11. The electrical supply system according to claim 8, wherein the electrical supply system comprises a plurality of adapters each comprising a LED or series of LED's, and the power supply being capable of providing a constant voltage.

12. The electrical supply system according to claim 1, wherein the complementary connection element of the connector pin comprises a spring or an elastic section.

13. The electrical supply system according to claim 1, wherein the connector pin comprises a flexible link between the first complementary connection element and the second complementary connection element.

14. An electrical supply system comprising:

an extension module comprising a composite board having an anode layer and a cathode layer of an electrically conducting material, which anode layer and cathode layer are separated by an insulator of an electrically insulating material, the anode layer and the cathode layer each having a trench extending from a connection surface of the composite board and comprising a connection element, the trench comprising a ridge extending along a wall of the trench, connector pins for the trenches of the extension module, each connector pin having a first complementary connection element for engaging a connection element of a trench of a composite board of another extension module and a second complementary connection element for engaging the connection element of the trench of the composite board of the extension module, and a power supply capable of providing a constant voltage or a constant current between the anode layer and the cathode layer.

15. The electrical supply system according to claim 14, wherein the trench has at least three ridges extending along the length axis of the trench with the tips of the ridges being placed on the perimeter of a circle defined in a plane normal to the length axis of the trench.

16. An electrical supply system comprising:

an extension module comprising a composite board having an anode layer and a cathode layer of an electrically conducting material, which anode layer and cathode layer are separated by an insulator of an electrically insulating material, the anode layer and the cathode layer each having a trench extending from a connection surface of the composite board and comprising a connection element, connector pins for the trenches of the extension module, each connector pin having a first complementary connection element for engaging a connection element of a trench of a composite board of another extension module and a second complementary connection element for engaging the connection element of the trench of the composite board of the extension module, a power supply capable of providing a constant voltage or a constant current between the anode layer and the cathode layer, the electrical supply system further comprising an electronic unit having a connection site with a connection element for engaging the complementary connection element of the connector pin, and an electronic component electrically connected to the connection element, and wherein the connection element is a hollow metallic cylinder with an outer helical thread.

17. The electrical supply system according to claim 16, wherein the electronic unit comprises a connector pin with a complementary connection element for engaging the connection element of the trench of the anode layer or the cathode layer of the extension module, and the electronic component is electrically connected to the connector pin.

* * * * *